United States Patent [19]

Flaig et al.

[11] Patent Number: 4,696,276

[45] Date of Patent: Sep. 29, 1987

[54] METHOD FOR INFLUENCING THE METERING OF FUEL TO AN INTERNAL COMBUSTION ENGINE

[75] Inventors: Ulrich Flaig, Markgröningen; Albrecht Sieber, Ludwigsburg, both of Fed. Rep. of Germany

[73] Assignee: Robert Bosch GmbH, Stuttgart, Fed. Rep. of Germany

[21] Appl. No.: 839,896

[22] Filed: Mar. 14, 1986

[30] Foreign Application Priority Data

Mar. 21, 1985 [DE] Fed. Rep. of Germany ..... 3510216

[51] Int. Cl.[4] ..... F02M 51/00

[52] U.S. Cl. ..... 123/478; 123/487

[58] Field of Search ..... 123/478, 480, 487, 488, 123/486; 364/431.06, 431.12

[56] References Cited

U.S. PATENT DOCUMENTS

| | | | |
|---|---|---|---|
| 4,196,702 | 4/1980 | Bowler | 123/487 |
| 4,250,858 | 2/1981 | Jeenicke et al. | 123/487 |
| 4,275,695 | 6/1981 | Bauer et al. | 123/487 |
| 4,359,992 | 11/1982 | Asano et al. | 123/487 |
| 4,367,530 | 1/1983 | Morinaga et al. | 123/487 |
| 4,387,684 | 6/1983 | Javari | 123/487 |
| 4,466,406 | 8/1984 | Hartung et al. | 123/487 |
| 4,561,400 | 12/1985 | Hattori | 123/478 |

*Primary Examiner*—Raymond A. Nelli

*Attorney, Agent, or Firm*—Walter Ottesen

[57] ABSTRACT

The invention is directed to a method for influencing the metering of fuel to an internal combustion engine, wherein the amount of fuel to be delivered to the engine is varied at least in dependence upon the number of revolutions or working strokes of the engine. In this method, the number of revolutions or working strokes of the engine is measured for subsequent storage in a volatile and a non-volatile storage. If a supply voltage failure causes the contents of the volatile storage to be lost, the more essential portion of this number for the engine continues to be available in the non-volatile storage. Embodiments are described explaining how the volatile and the non-volatile storage can be realized and combined. Also, a description is provided as to how the metering of fuel can be influenced in dependence upon the number of revolutions or working strokes of the internal combustion engine.

10 Claims, 1 Drawing Figure

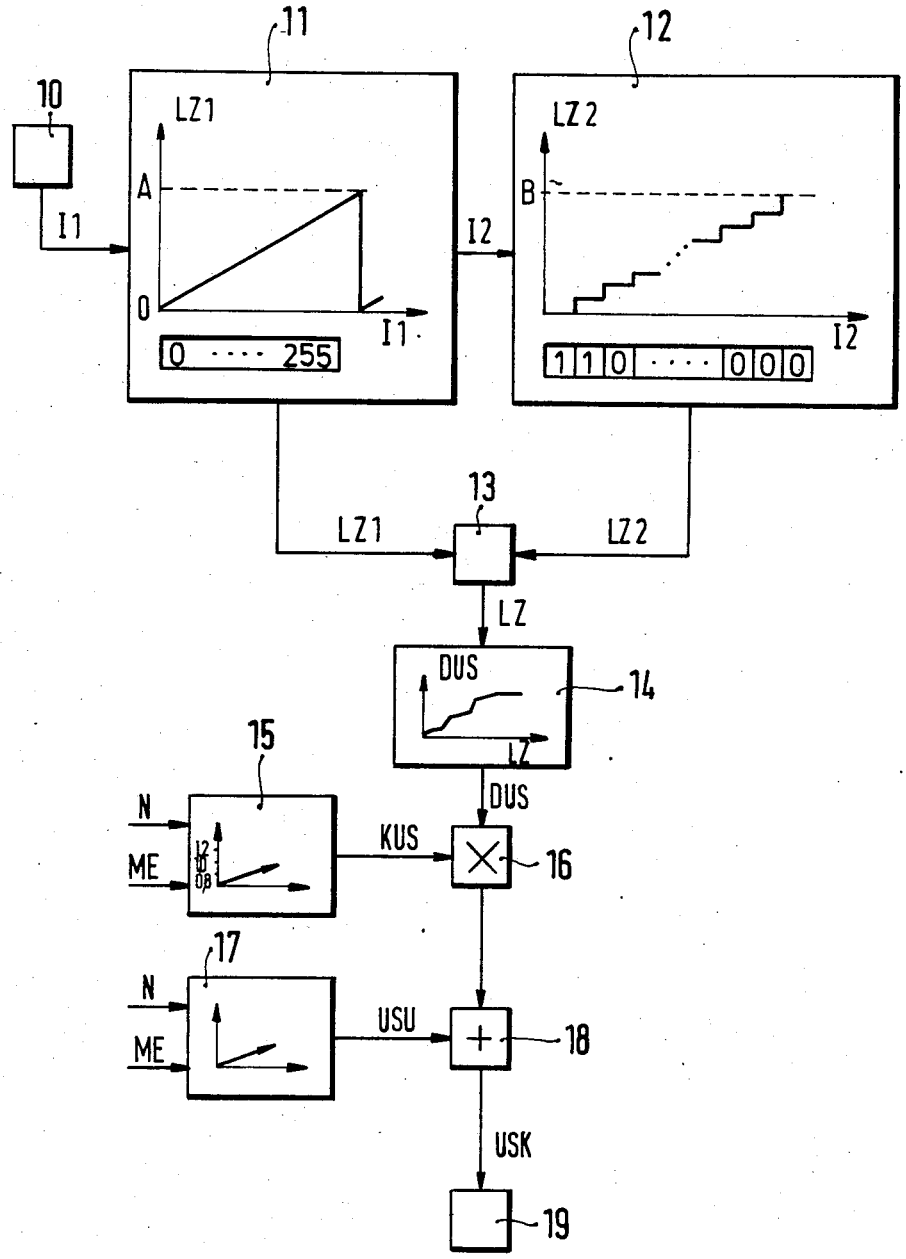
11
12
10
LZ1
A
0
I1
0 .... 255
I2
LZ2
B
I2
1 1 0 .... 0 0 0
13
LZ1
LZ2
LZ
DUS
14
LZ
DUS
15
N
ME
KUS
16
17
N
ME
USU
18
USK
19

METHOD FOR INFLUENCING THE METERING OF FUEL TO AN INTERNAL COMBUSTION ENGINE

FIELD OF THE INVENTION

The invention relates to a method for influencing the metering of fuel to an internal combustion engine at least in dependence upon a quantity characterizing the total number of revolutions or total number of working strokes of the engine, with an apparatus for measuring the quantity characterizing this number of the engine, and an apparatus for influencing the metering of fuel to the engine.

BACKGROUND OF THE INVENTION

Internal combustion engines or at least parts thereof are known to be subject to wear and use in the course of their operating time. Thus, for example, injection pumps of diesel engines are known to exhibit a drift in fuel delivery in the course of their operating time, that is, they meter a progressively increasing amount of fuel to the internal combustion engine while the setting remains unchanged. Similar drifts in fuel delivery are also known from gasoline engines because of analogous processes. Since these drifts are measurable, it is possible to determine the drift behavior of the engine as a consequence of wear and use by means of tests. On the basis of this information, the drift behavior can be corrected by recording the total number of revolutions or total number of working strokes of the engine which is indicative of wear and use and hence of aging. In dependence upon the time recorded, the amount of fuel to be metered to the internal combustion engine is influenced, for example, reduced. With such a drift compensation, however, the basic problem is to "retain" the total number of revolutions or working strokes of the internal combustion engine, that is, to store it in some way.

SUMMARY OF THE INVENTION

It is an object of the invention to provide a method to influence the metering of fuel into the internal combustion engine in dependence upon the revolutions or working strokes of the engine in a simple and reliable manner. This is accomplished in that the total number of revolutions or total number of working strokes of the internal combustion engine is retained by means of a volatile and a non-volatile storage. The volatile storage holds a period of time which extends from an initial value to a predeterminable maximum value and is reset to the initial value when the maximum value has been reached. The non-volatile storage holds the number of times the maximum value has been reached. The total number of revolutions or total number of working strokes of the engine is then composed of the number of times that the volatile counter has counted from its initial value to its maximum value and the count in the volatile storage.

In one embodiment of the invention, it is particularly advantageous to determine a value characterizing the age-induced drift in fuel delivery to the internal combustion engine in dependence upon the total number of revolutions or total number of working strokes of the engine and on the basis of tests carried out.

In another particularly advantageous improvement of the invention, the value characterizing the drift in fuel delivery is influenced multiplicatively and/or additively. These influences, in turn, may depend upon at least the rotational speed of the internal combustion engine and/or the amount of fuel to be metered to the engine.

Another advantage of the invention is that, in the event of the internal combustion engine being exchanged, the count of the number of revolutions or working strokes of the engine can be corrected simply by using a new non-volatile storage or by allocating a new storage location in the old non-volatile storage to store the number of times the maximum value has been reached in the volatile storage.

Further advantages and improvements of the invention will become apparent from the following description in conjunction with the drawing and the claims.

BRIEF DESCRIPTION OF THE DRAWING

The invention will now be described in more detail with reference to the drawing wherein the sole FIGURE thereof is a schematic block diagram showing a drift which is a compensation for the metering of a progressively increasing amount of fuel to the engine as a consequence of aging of the engine or at least of its parts with use.

DESCRIPTION OF THE PREFERRED EMBODIMENTS OF THE INVENTION

The drawing shows an embodiment for compensating for drift in a diesel engine. In principle, it is also possible to apply such a drift compensation to a gasoline engine in an analogous manner. In the FIGURE, the embodiment is described with reference to a block diagram. This block diagram can be converted into an actual embodiment of a drift compensation by means of an electric circuit made up of discrete and/or integrated components, as well as by means of a suitably programmed electronic computing device with associated peripheral devices.

In the drawing, reference numeral 10 identifies a measuring apparatus which issues a signal I1. Signal I1 is made up of pulses characterizing each working stroke of the engine, or each engine revolution. Signal I1 is conducted to a first counter 11 for counting the pulses indicative of the revolutions or working strokes of the engine. This counter 11 is a counter which, in dependence upon the pulses of signal I1, that is, in dependence upon the quantity characterizing the aging of the internal combustion engine, counts upwardly from an initial value, for example, zero, to a final value, for example 255. After the counter has reached its final value, it will start counting again from its initial value. This count can be performed particularly advantageously by means of an 8-bit binary counter which continues counting automatically from 255 binary value to 0 binary value. Each time the count reaches the final value, the first counter 11 will generate a signal I2 which is conducted to a second counter 12. The count value 255, that is, the final value of the count, corresponds to the value A. Since value A represents the counter reading of counter 11 after each completion of this a count to said count value of 255, counter 11 is reset from its final value to its initial value while at the same time output signal I2 is generated. The instantaneous value of the count of counter 11 is available at any time in the form of signal LZ1 at another output of the first counter 11.

As stated in the foregoing, signal I2 from the first counter 11 activates the second counter 12 in the form of single pulses. Each pulse of signal I2 effects a change of a cell of the second counter 12 from its initial state to its opposite state. The second counter 12 may have any arbitrary number of cells which are then changed in succession from their initial state to their opposite state, in dependence upon the successive pulses of signal I2. It is especially advantageous to use a binary storage for the second counter 12 in which successive storage cells are changed from their binary 0-value to their binary 1-value, for example. The maximum value the second counter 12 can reach depends on the number of cells available and corresponds to a maximum measurable number B of revolutions or working strokes of the engine. The output signal of the second counter 12 is signal LZ2 which is available at any time and which comprises the number of storage cells changed to their opposite states.

As already described, signal LZ2 identifies the number of times the first counter 11 has reached the maximum count A, whereas signal LZ1 identifies the instantaneous value of the first counter 11. These two signals LZ1 and LZ2 are combined in point 13 to form signal LZ. This operation is performed in a manner according to the following equation: $LZ=LZ1+LZ2\times A$. Signal LZ thus indicates the actual number of revolutions or working strokes of the internal combustion engine.

The particular advantage of the method for deriving the actual number of revolutions or working strokes of the internal combustion engine so far described is that the storage of this number is divided into two different units or parts, that is, the parts contained in the first and the second counters 11 and 12, respectively. This makes it possible to use a volatile storage for the first counter 11 and a non-volatile storage for the second counter 12. Both the volatile and the non-volatile storage or a storage containing a volatile and an non-volatile part require a voltage supply for their operation. While the non-volatile storage has the characteristic of retaining its stored information even when the voltage supply is cut off, the volatile storage loses all its data in a state without voltage.

In a motor vehicle it cannot be ensured that the voltage supply is available at any instant of vehicle operation. Circumstances such as repairs, for example, may even necessitate the supply voltage to be shut off. If only a volatile storage were used for storage of the number of revolutions or working strokes of the internal combustion engine, all its stored information would be lost the moment the supply voltage is removed from the volatile storage, that is, the operating time of the internal combustion engine so far recorded would be lost. By contrast, if only a non-volatile storage were used, the number of revolutions or working strokes of the engine would be retained also when the supply voltage is cut off; on the other hand, however, the storage space required for storing this number would have to be very large. Since these requirements cannot be normally met, the storage of this number of revolutions or working strokes in the non-volatile storage would have to be simplified a great deal which would sdubstantially impair the accuracy of the stored information and possibly make it unusable. If, however, the combination of a volatile storage with a non-volatile storage is used for storing the number of revolutions or working strokes of the internal combustion engine as described in the foregoing, a failure of the supply voltage results in a loss of only that part of the this number that is defined by the volatile storage. The contents of the non-volatile storage are retained.

According to the above, the first counter 11 performs a short-time count while the second counter 12 performs a long-time count. This explains the fact that the first counter 11 is reset to an initial value from which it starts counting up again, whereas the second counter 12 performs a continuous count which is not reset. If the first counter is a volatile storage and the second counter a non-volatile storage, only the short-time count is lost in the event of a supply voltage failure, while the long-time count is retained. Following such a failure, the number of revolutions or working strokes of the engine counter 12 thus contains an error which has a maximum of value A and which has an average of value A/2.

It is particularly advantageous to use a RAM as the volatile storage and a PROM or EPROM or an EEPROM as the non-volatile storage. The use of an EEPROM as non-volatile storage affords a particularly simple and advantageous way of correcting the number of revolutions or working strokes after an exchange of the internal combustion engine or parts thereof by resetting the appropriate cells of EEPROM electrically to their initial values. By contrast, if an EPROM is used as non-volatile storage, an exchange of the internal combustion engine also necessitates an exchange of the EPROM, or the old EPROM has to be reset to its initial values in a suitable way, for example, by subjecting it to ultraviolet light. If a PROM is used as volatile storage, an exchange of the internal combustion engine also requires the PROM to be replaced.

By means of the actual number of revolutions or working strokes LZ of the internal combustion engine which is now available at the output of connecting point 13, it is possible to correct or compensate for the effects of wear of the internal combustion engine in dependence upon the number LZ. For this purpose, signal LZ is applied to aging characteristic field 14 which generates an output signal DUS, a so-called drift signal, in dependence upon signal LZ. Since wear-induced variations of the amount of fuel supplied to the internal combustion engine further depend on the operating condition of the engine, signal DUS is corrected by means of correction characteristic field 15 and multiplication point 16. Correction characteristic field 15 in turn depends on the rotational speed N of the internal combustion engine and the amount of fuel ME to be supplied to the internal combustion engine.

The output signal KUS of correction characteristic field 15 has a value which varies about value 1 and thus represents a weighting factor for the drift signal DUS. Finally, the output signal of multiplication point 16 is applied to summing point 18 with a negative operational sign. Summing point 18 further receives a signal USU which is the non-corrected desired value for the supply of fuel to the internal combustion engine. Signal USU is generated by pump characteristic field 17, which derives this signal at least in dependence upon the rotational speed N of the internal combustion engine and the amount of fuel ME to be supplied thereto. The output signal of summing point 18 is designated by the symbol USK which represents a corrected desired value for the metering of fuel to the internal combustion engine, with the correction being related to the effects of wear of the engine. This last-named signal USK operates on the internal combustion engine, for example, on an injection pump 19 for metering fuel to the internal combustion engine.

Overall, the following equations are realized with the block diagram shown in the drawing:

$LZ=LZ1+LZ2\times A$ $DUS=f(LZ)$ $KUS=f(N, ME)$ $USU=f(N, ME)$ $USK=USU-DUS\times KUS$ The drift compensation described and in particular the storage of the number of revolutions or working strokes of the internal combustion engine in a volatile and a non-volatile storage provide a particularly advantageous way of storing, that is, retaining, this number for the engine simply and reliably and thus of accomplishing a likewise simple, but nonetheless effective, drift compensation by having the metering of fuel into the internal combustion engine influenced in dependence upon the stored number of revolutions or working strokes of the engine. As described, this influence may be accomplished in a multiplicative and/or additive manner as well as by means of a suitable aging characteristic field.

It is understood that the foregoing description is that of the preferred embodiments of the invention and that various changes and modifications may be made thereto without departing from the spirit and scope of the invention as defined in the appended claims.

What is claimed is:

1. A method for controlling the metering of fuel to an internal combustion engine as a function of at least one of the revolutions of the engine and the working strokes of the engine, using a first means for measuring a quantity (LZ) representing one of said revolutions of the engine and said working strokes of the engine as engine elapsed operating time, said method comprising the steps of:

(1) memorizing said (LZ) quantity with a volatile storage second means (11) between the values of (0) and (A), with (LZ1) representing the non-volatile storage value between (0) and (A);

(2) resetting (LZ1) to (0) when said (A) value is reached;

(3) transferring said (A) value to a non-volatile storage third means (12) each time said (A) value is reached;

(4) compounding said non-volatile storage value (A) up to a predetermined quantity (B);

(5) generating a drift-correction signal (DUS) in dependence upon said non-volatile storage value (B) represented by (LZ2);

(6) developing an aging characteristic field (14) from input signal LZ which satisfies the relationship $$LZ=LZ1+LZ2\times A;$$

and, (7correcting speed (15) and pump (17) characteristic fields with said drift correction signal (DUS) to provide the proper metering to injector (19).

2. The method of claim 1, wherein said number (LZ) satisfies the following equation:

$$LZ=LZ1+LZ2\times A$$

3. The method of claim 1, comprising: generating a drift-correction signal (DUS) in dependence upon said quantity (LZ) with the aid of an aging characteristic field.

4. The method of claim 3, wherein said drift signal is multiplicatively influenced.

5. The method of claim 4, wherein the multiplicative influencing is dependent at least upon one of the following: the rotational speed of the engine (N) and the mass of fuel metered to the engine.

6. The method of claim 3, wherein said drift signal is additively influenced.

7. The method of claim 6, wherein the additive influencing is dependent at least upon one of the following: the rotational speed of the engine (N) and the mass of fuel metered to the engine.

8. The method of claim 1, wherein said non-volatile storage component is set to its initial value by replacing said non-volatile storage component or the entire storage unit.

9. The method of claim 1, wherein said non-volatile storage component is set to its initial value by erasing said non-volatile storage component.

10. The method of claim 1, wherein said non-volatile storage component is set to its initial value by utilizing a new storage area.

* * * * *

UNITED STATES PATENT AND TRADEMARK OFFICE

CERTIFICATE OF CORRECTION

PATENT NO. : 4,696,276

DATED : September 29, 1987

INVENTOR(S) : Ulrich Flaig and Albrecht Sieber

It is certified that error appears in the above-identified patent and that said Letters Patent is hereby corrected as shown below:

In column 2, line 60: delete "this".

In column 3, lines 59 and 60: delete "sdubstantially" and substitute -- substantially -- therefor.

In column 4, line 11: after "engine" please insert -- obtained by the long-time count of the second --.

Signed and Sealed this

Second Day of August, 1988

*Attest:*

*Attesting Officer*

DONALD J. QUIGG

*Commissioner of Patents and Trademarks*